US006095760A

United States Patent [19]

Houtman

[11] Patent Number: 6,095,760

[45] Date of Patent: Aug. 1, 2000

[54] FLUID PUMPING APPARATUS WITH TWO-STEP LOAD LIMITING CONTROL

[75] Inventor: Paul K. Houtman, Gobles, Mich.

[73] Assignee: Parker-Hannifin Corporation, Cleveland, Ohio

[21] Appl. No.: 09/164,878

[22] Filed: Oct. 1, 1998

Related U.S. Application Data

[60] Provisional application No. 60/064,293, Nov. 5, 1997.

[51] Int. Cl.[7] ..... F04B 1/26

[52] U.S. Cl. ..... 417/222.2; 417/222.1; 417/218

[58] Field of Search ..... 417/222.2, 222.1, 417/270, 280, 218

[56] References Cited

U.S. PATENT DOCUMENTS

| | | | |
|---|---|---|---|
| Re. 31,711 | 10/1984 | Horiuchi . | |
| 4,275,997 | 6/1981 | Woodring et al. | 417/218 |
| 4,285,639 | 8/1981 | Woodring et al. | 417/218 |
| 5,123,815 | 6/1992 | Larkin et al. | 417/222.1 |
| 5,183,393 | 2/1993 | Schaffner . | |
| 5,486,097 | 1/1996 | Schaffner . | |
| 5,562,424 | 10/1996 | Manring . | |
| 5,567,123 | 10/1996 | Childress et al. . | |
| 6,033,188 | 3/2000 | Baldus et al. | 417/222.1 |

*Primary Examiner*—Teresa Walberg
*Assistant Examiner*—Vinod D. Patel
*Attorney, Agent, or Firm*—Christopher H. Hunter

[57] ABSTRACT

A fluid power pumping apparatus having a control system for limiting the power loading thereon to the power available from a motor (172) driving the apparatus, includes a variable displacement rotating piston pump (170). A compensating valve assembly (174) of a type known in the prior art is mounting on the pump. The compensating valve controls flow volume through the pump in response to pressure at an outlet (176) of the compensating valve. The outlet is connected to a variable load limiting control (180). The load limiting control includes a low flow adjustment which varies according to the position of a cam (186) which is connected to the swash plate of the pump, and a high-flow cut-off. The load limiting control reaches higher operating pressures while operating within the power delivery capabilities of the motor. Both the low flow adjustment and high-flow cut-off are manually adjustable to tailor the pump to the operating characteristics of the motor.

9 Claims, 6 Drawing Sheets

FLUID PUMPING APPARATUS WITH TWO-STEP LOAD LIMITING CONTROL

RELATED CASE

The present application claims priority to U.S. Provisional Application Ser. No. 60/064,293; filed Nov. 5, 1997.

FIELD OF THE INVENTION

The present invention relates to pumping apparatus used in fluid power systems. Specifically, this invention relates to a load limiting control system for a variable displacement rotating piston pump.

BACKGROUND OF THE INVENTION

Variable displacement rotating pumps are well known in the prior art. One such pump is shown and described in U.S. Pat. No. 5,123,815, which is incorporated herein by reference. These types of pumps are often used in hydraulic systems to provide fluid power to components such as hydraulic systems to provide fluid power to components such as hydraulic cylinders and rotary actuators. An exploded view of a typical variable displacement rotating piston pump is shown in FIG. 1.

The pump 10 generally indicated includes a case which has a first section 14 and a second section 16. A plurality of movable pistons 18 are mounted inside the case in a carrier 20. A spring inside carrier 20 biases multiple pins 15 against a ball guide 17. The ball guide pushes against a slipper retainer 19. The slipper retainer biases the pistons away from the carrier. The carrier and pistons are rotatable inside the case when driven by a drive shaft 22.

A swash plate 24 is mounted inside the pump case. A wear plate 26 is positioned on the swash plate when the pump is assembled. As later explained, when the pump is operated, the pistons 18 ride on the wear plate 26. The swash plate is mounted to the case by a pair of mounting pins 28 which extend into mounting holes 30 in the first section of the case. Bearings 34 support the pins in the mounting holes, and retaining rings 36 keep the bearings and pins from moving laterally inside the case. The mounting of the swash plate 24 enables it to swivel about an axis perpendicular to the axis of rotation of shaft 22 and pistons 18.

A biasing spring 38 is mounted in the pump case. A spring guide 40 positioned on spring 38, contacts swash plate 24 to bias it in a first direction. A servo piston 42 is mounted on the second section 16 of the case. Servo piston 42 contacts the swash plate 24 on a side opposite the spring guide 40.

A fluid directing plate 44 is mounted adjacent to piston carrier 20 and directs fluid into inlet and outlet passage 46 and 48 respectively, in the second section 16 of the pump case.

The operation of the variable displacement rotating piston pump is further explained with reference to FIG. 2. Fluid is delivered to the pump through an inlet 50 in case 12. The inlet 50 is connected to inlet passage 46. Fluid in the inlet passage flows into the pistons 18 when they are located in the lower portion of the pump as shown in FIG. 2. When servo piston 42 is in the retracted position as shown in FIG. 2, swash plate 24 is tilted at an angle by the force of spring 38.

The pistons 18 include ball-shaped slippers 52 which swivel. The ball-shaped slippers also include a small fluid passage 54. A small amount of fluid flows to the bottom of the ball-shaped slippers through passages 54 which enable the piston assemblies to slide on wear plate 26 with minimum friction.

When shaft 22 rotates, it rotates carrier 20 and the pistons 18. As shown in FIG. 2, because swash plate 24 is tilted, the fluid is pushed out as the pistons approach the upper portion of the pump case and fluid flows out of outlet passage 48. As a result, fluid is delivered from the pump at an outlet 56. Fluid is pulled into the pistons when they are pulled away form the fluid directing plate 44 as they pass through the opposite area of their rotational path. As can be seen in FIG. 2, the greater the angle of swash plate 24, the larger the volume of fluid pumped at a given rotational speed of the shaft.

Fluid power systems typically operate at variable pressures. This is because the devices that perform the work, a hydraulic cylinder for example, often encounter variable resistance to movement. A log splitter which operates using a hydraulic cylinder is an example of this phenomenon. The wedge which contacts and splits the log is attached to the cylinder. Until the wedge contacts the log, the cylinder moves the wedge with little resistance. As a result, pressure of the working fluid in the cylinder is low. When the wedge contacts the log, the resistance to further movement (and the pressure inside the cylinder) builds rapidly. Once the log fractures, the resistance force drops and the corresponding pressure in the cylinder drops as the wedge continues to move against less resistance.

If a piston pump with a fixed displacement were used to power the hydraulic cylinder of a log splitter or other device that encounters variable force, the amount of power required to drive the pump during the high pressure periods would be very high. Thus, a very large motor would be required. Further, if the power required to drive the log splitter or other device required to drive the log splitter or other device became higher than the motor could deliver, the motor would stall and the pump would stop.

Variable displacement rotating pumps can be used to minimize these problems. This is accomplished by varying the angle of the swash plate. When the pressure in the system rises, the angle of the swash plate is reduced, thereby drawing less fluid into and pushing less fluid out of the pistons. Flow through the pump is reduced. This maintains the amount of power the motor driving the pump must supply within a manageable range.

A prior art system which reduces the flow through the pump at high pressure is shown in FIG. 2. This system includes a first compensator valve assembly 58. Valve assembly 58 has a body which houses a first internal chamber 62 and a second internal chamber 64. A compensator spool 66 is movably mounted in the first internal chamber 62. A pre-load spring 68 is mounted in the internal chamber 64. The pre-load spring 68 biases compensator spool 66 to the left as shown in FIG. 2. The biasing force is set by turning an adjusting nut 70 which is attached to an adjusting rod 72 threaded in body 60.

First chamber 62 is in fluid communication with outlet passage 48 through a fluid passage 74. First chamber 62 is also in fluid communication with the interior of servo piston 42 through a fluid passage 76.

The pressure at the outlet 56 of the pump rises when the fluid power system supplied by the pump increases its working pressure. When this occurs, the pressure correspondingly increases in chamber 62 and attempts to push the compensator spool toward the right. If the outlet pressure rises high enough to overcome the force of pre-load spring 68, the compensator spool will move to the right of the position shown. When the spool moves, fluid pressure from chamber 62 is delivered to fluid passage 76 and into the interior of the servo piston 42. The servo piston moves to the right overcoming the force of spring 38. When the servo piston extends, the angle of the swash plate decreases. This reduces the volume of fluid flowing through the pump. As a result, the motor driving the pump does not have to provide as much power. This is because the pump is delivering a lesser volume of fluid at the elevated pressure.

When the pressure at outlet 56 drops, pre-load spring 68 moves the compensator spool back to the left. Fluid in the servo piston is pushed back through flow passage 76 into chamber 66. The fluid then passes through a fluid passage 78 into a low pressure area inside the pump case. When the fluid pressure in the servo piston is relieved, the piston retracts and the volume of flow through the pump increases.

A problem with this system is that it cannot take full advantage of the power available from a particular motor. This is because the compensator valve must be preset to lower the flow whenever a set fluid pressure is exceeded. The power delivered by a piston pump is a function of both volume and pressure. As this compensator valve assembly works on pressure only, it cannot take full advantage of the power available.

Another type of prior art control valve for controlling the operation of a variable displacement rotating piston pump is shown in FIG. 3. This system includes a second compensating valve 80 which has a body 82. Body 82 includes first, second and third internal chambers 84, 86 and 88 respectively, which are connected. First chamber 84 is in communication with outlet passage 48 of the pump through a fluid passage 90. Second chamber 86 is connected to servo piston 42 of the pump through a fluid passage 92. Third chamber 88 is connected to a fluid passage 94 which extends through body 82. Fluid passage 94 extends through a fourth chamber 96 to a control port 98.

A spool 100 is movably mounted in the valve body and extends through the first, second and third chambers. Spool 100 includes an internal orifice passage 102 which enables fluid to pass from the first chamber 84 to the third chamber 88 through the interior of spool 100. A differential spring 104 biases the spool to the left as shown in FIG. 3.

In operation of the second compensator valve 80, the flow through the pump (and thus the power required to drive the pump) may be controlled by varying the pressure at control port 98. The pressure delivered at the outlet 56 of the pump is communicated to first chamber 84 through fluid passage 90. The fluid pressure in the first chamber 84 is metered to third chamber 88 through orifice passage 102 in spool 100. In the position of the spool shown in FIG. 3, no fluid is delivered to the servo piston 42 which is shown in its fully retracted position.

When the pressure at pump outlet 56 exerts a pressure on spool 100 which exceeds the biasing force of the differential spring 104 plus the controlled fluid pressure at control port 98, the spool moves to the right of the position shown in FIG. 3. When this occurs, fluid delivered to the first chamber 84 is enabled to pass into the servo piston 42 through the second chamber 86 and flow passage 92. As the servo piston extends, the angle of the swash plate 84 is reduced and the volume of fluid flow through the pump drops.

When the pressure at the outlet 56 falls (or the control pressure at control port 98 increases) so that the forces pushing spool 100 to the left are greater than the pressure at the outlet port pushing it to the right, spool 100 moves back to the position shown in FIG. 3. When this occurs, fluid in servo piston 42 flows back into the second chamber 86 through flow passage 92. Then the fluid in the second chamber 86 flows into the case through a flow passage 106. As fluid leaves the servo piston it retracts, and the flow through the pump increases.

Although the system described above provides for variable control of the servo pistons of the pump, there is a need to provide a pressure relief control to be sure the maximum pressure capability of the pump is not exceeded. This control is provided by a pressure relief valve portion generally indicated at 108. The pressure relief valve portion includes an adjustable rod 110 which extends through fourth chamber 96. The valve is threaded and the valve body and its position may be changed by rotating an adjusting nut 112. Rod 110 has an internal fluid chamber 114 which is open to fourth chamber 96 as shown.

A dart 116 is adjacent the opening to internal fluid chamber 114. A spring 118 biases the dart to close the opening. When the force of spring 118 is exceeded by the force of the fluid in fourth chamber 96, the dart is pushed to the left and relieves pressure through a fluid passage 120 to second chamber 86. Fluid passage 120 is positioned so fluid therefrom is always passed to the case regardless of the position of spool 100. Relief valve portion 108 provides a fixed maximum pressure that can be held at control port 98, and thus the maximum pressure that can be produced at the outlet port of the pump before the servo piston moves to reduce flow.

The prior art construction of the second compensating valve is useful in that it provides for variable control of the volume of flow through the pump. However, it does not solve a significant problem associated with variable displacement rotating piston pumps, that is, to control the volume flow through the pump in relation to the outlet pressure so that the power producing capabilities of a motor which is used to drive the pump are not exceeded. At the same time it is also necessary to fully utilize the power available from the motor.

A still further prior art valve is shown in FIG. 4. In this valve, the swash plate of the pump is mounted on trunion pins similar to pins 28 previously described, however, one of the pins 138 is adapted to include an offset cylindrical cam 140 which extends outward from the pump case. The pin and the attached cam move with the angle of the swash plate. The cam is in a first position when the swash plate of the pump is at a minimum angle and the pump is providing minimum flow. The cam is in a second position when the swash plate is at its maximum angle and the pump is providing its highest volume flow.

The outlet or control port of the compensating valve is connected to a variable pressure relief valve 134. The variable relief valve is engaged by the cam 140 on the pin 138 which moves with the swash plate. The variable relief valve has an inlet passage 142 which is connected to control port 98 of valve 80 (FIG. 3). The relief valve also has an outlet opening 162 which is connected to the interior of the pump case. A spring-biased, manually-adjustable dart valve 156 is disposed in a passageway 144 between the inlet passage 142 and the outlet opening 162. The dart valve is also responsive to a moveable follower 160, which is biased by the movement of cam 140 on pin 138. Pressure received in inlet 142 is controlled through the dart valve and relieved through outlet opening 162 when the pressure exceeds the preset bias on the dart valve and the bias cause by cam 140. The variable relief valve 134 has a maximum relief pressure when the cam is in the first position (minimum flow) and has a minimum relief pressure when the cam is in the second position (maximum flow).

In operation, the pump is driven by a motor with a fixed power delivery capability. When the pump is delivering fluid to the system and the system is at a low pressure, the swash plate is at its greatest angle and providers maximum flow. If the system encounters increasing resistance, pressure rises at the outlet of the pump. Because at maximum flow, the variable relief valve relieves at a low pressure, it relieves as the system encounters greater resistance. This drops the pressure at the outlet of the compensating valve.

The drop in pressure at the outlet of the compensating valve causes the spool located therein to move to the right of the position of the spool shown in FIG. 3. When the spool moves, fluid is delivered to servo piston 42. The servo piston extends—moving the swash plate and lowering the volume of flow through the pump.

When the swash plate moves to a smaller angle to reduce flow, the cam 140 which is located on the pin 138, moves towards its first position. This increases the relief pressure. As a result, the variable relief valve 134 eventually closes, again raising the pressure at the outlet port. This causes the spool to move back to the left and to relieve pressure to the servo piston until equilibrium is obtained.

A closed loop system is thus provided, which maintains flow and pressure output from the pump within the power delivery capability of the motor which drives the pump.

While this system has many advantages, the flow is strictly dependent upon pressure—that is, as the pressure to the pump increases, the flow decreases in order to stay within the capabilities of the motor. The system can be somewhat limited in applications which operate under higher pressures. There is no adjustment to allow the system to be functional over a broad range of pressure operating conditions and which nonetheless stays within the power delivery capability of the motor.

Applicants are aware of certain prior variable displacement rotating piston pumps which have torque limiting control. However, applicants believe such prior pumps do not have the ability to easily adjust to a broad range of operating requirements; have required multiple springs and orifices and other complex and costly mechanisms; and/or can allow performance fluctuations under some operation conditions.

SUMMARY OF THE PRESENT INVENTION

The present invention provides a novel and unique variable displacement rotating piston pump. The pump minimizes the required components, and effectively reaches higher pressures, that is, offers a broader pressure operating range, while staying within the power delivery capability of the motor. The pump also has a relatively simple construction which is stable over a broad range of operating conditions.

According to the preferred form of the present invention, the pump includes a load limiting control which allows control of the low flow setting of the pump, as well as adjustment of the pressure at which the pump transitions from high flow to low flow.

The low flow setting is accomplished by a control spool which is closely and slidably received in a sleeve. The sleeve includes an internal flow path which fluidly interconnects an inlet passage from the compensator valve cavity with an outlet passage to the high-flow cut-off adjustment. The relative position between the spool and the sleeve determines the flow through the internal flow path in the sleeve. The spool is engaged by the cam attached to the swash plate, and as the swash plate rotates, the spool moves from a position maximizing the flow through the sleeve (maximum flow through pump) to a position minimizing flow through the sleeve (minimum flow through pump). The low flow adjustment is also separately manually adjustable, which allows the low flow adjustment to be tailored for the particular operating characteristics of the motor.

The high-to-low flow transition is accomplished by a spring-biased cut-off valve which is connected between the outlet passage of the low-flow adjustment and a passage leading to the pump case (ambient). The cut-off valve is also separately manually adjustable, which allows the low-flow cut-off pressure to also be tailored for the particular operating characteristics of the motor.

When the high flow cut-off valve is open at high pressures, the spool in the compensator cavity directs flow to the servo piston, thereby reducing the swash plate angle and the output flow from the pump. As the swash plate rotates, the low flow spool restricts flow to the high flow cut-off valve. With the path restricted, the pump remains at the reduced flow until the maximum operating pressure is reached, at which point the pressure relief valve in the compensator cavity opens. The low-flow adjustment and the high-to-low flow cut-off provide a broader pressure operating range, while operating within the power delivery capability of the motor. The low-flow setting and high-flow cut-off can be easily adjusted to closely match the pump to the theoretical capabilities of the motor. The load-limiting control is accomplished with relatively few parts which are straightforward to manufacture and assemble, are stable over a broad range of operating conditions, and which are easy to maintain over a long operating lifetime.

Further features of the present invention will become apparent to those skilled in the art upon reviewing the following specification and attached drawings.

DETAILED DESCRIPTION OF THE PREFERRED EMBODIMENT

Figure 5:
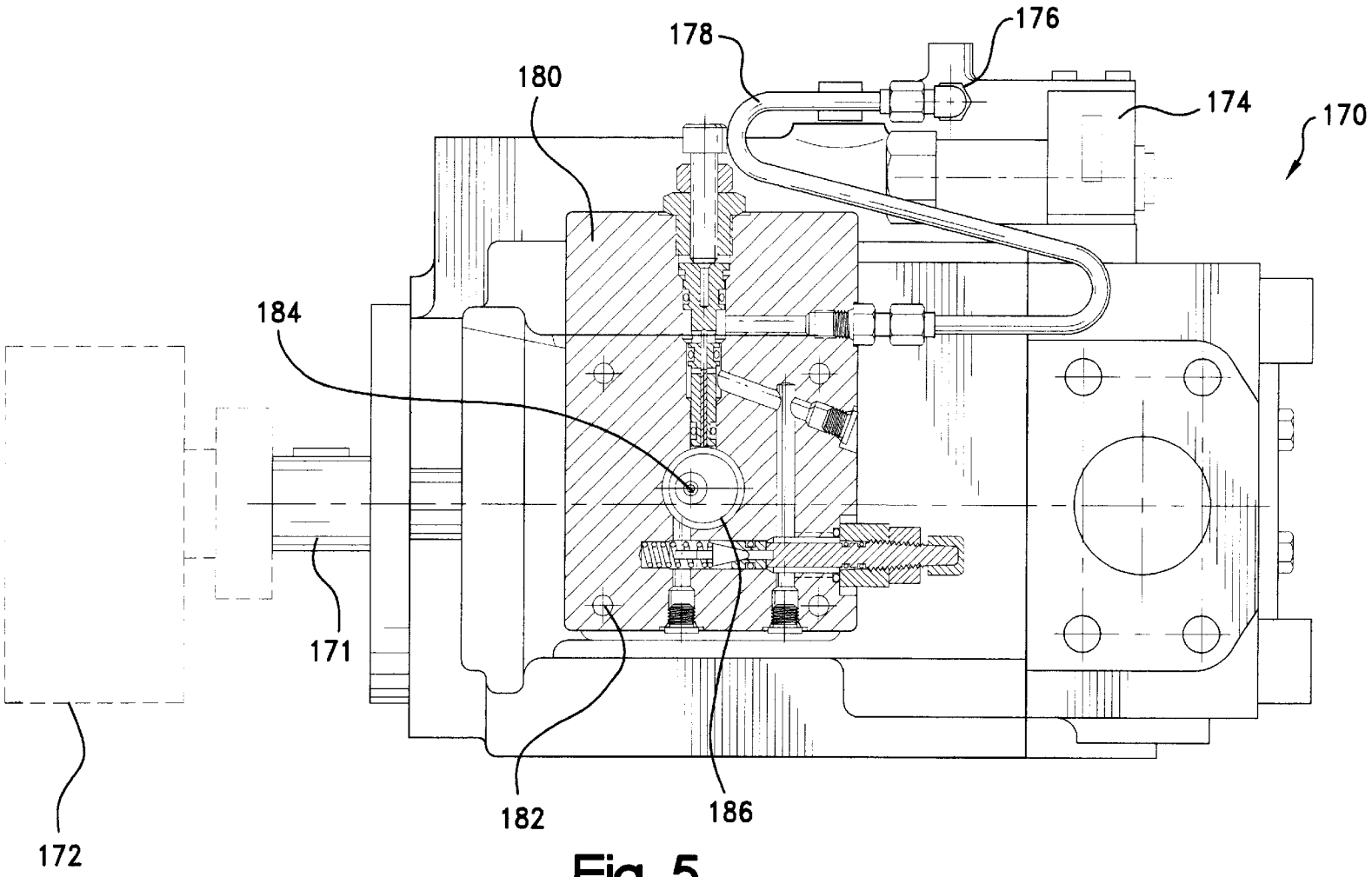
FIG. 5 is partially sectioned view of a variable displacement rotating piston pump incorporating the preferred embodiment of the present invention.

Referring now to the drawings and particularly to FIG. 5, there is shown therein a variable displacement rotating piston pump 170. Pump 170 is identical in all respects to prior art pump 10 previously described with the exceptions mentioned. Pump 170 has a shaft 171 which is driven by an electric motor 172 shown in phantom. The electric motor is a typical A/C electric motor which has a fixed maximum horsepower output capability and a fixed rotational speed.

A compensating valve assembly 174 is mounted on pump 170. The compensating valve assembly is identical in all respects to the second compensating valve 80 previously described. Compensating valve assembly 174 has an outlet 176 which corresponds to control port 98 of valve 80. Outlet 176 is connected to a pipe 178 which is connected to a load limiting control 180. The load limiting control 180 is held to the case of pump 170 by fasteners 182.

Figure 1:
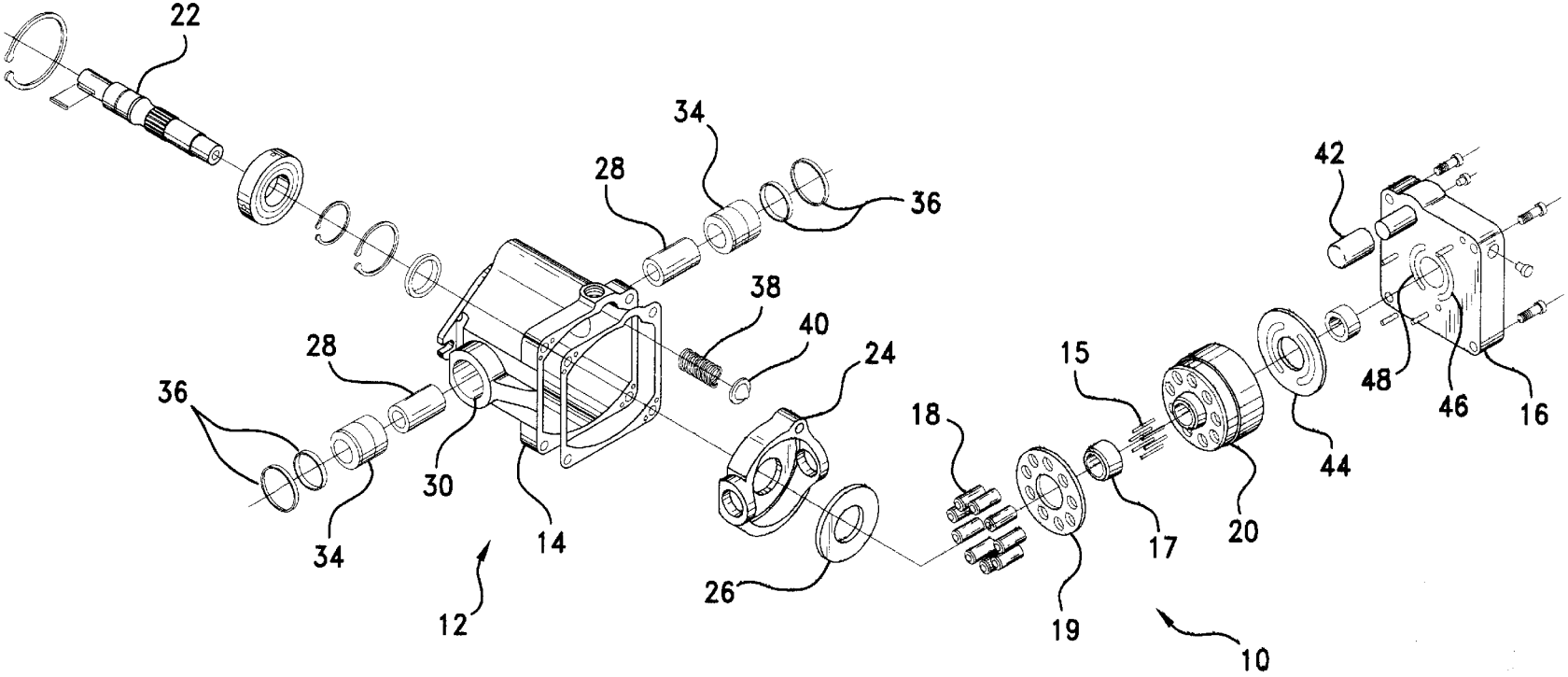
Fig. 1 (PRIOR ART)
FIG. 1 is an exploded view of a prior art variable displacement rotating piston pump.
Figure 2:
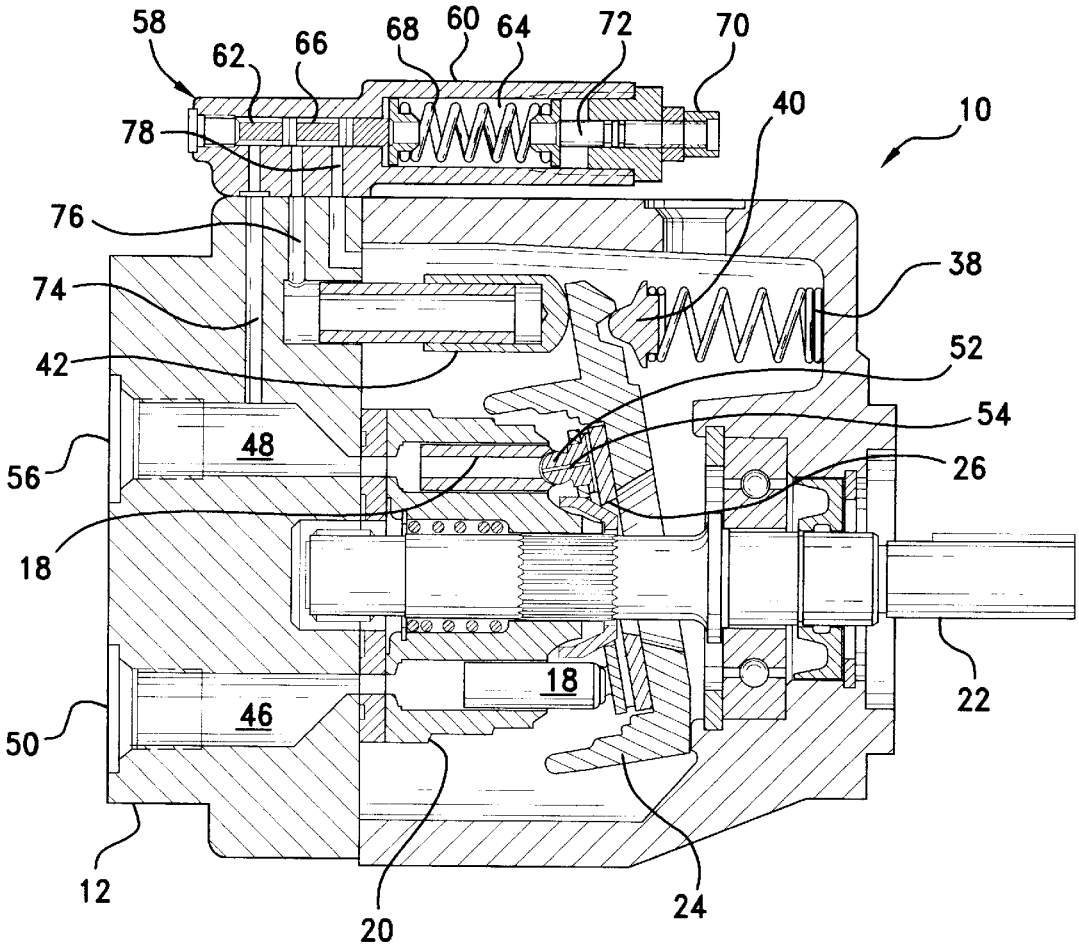
Fig. 2 (PRIOR ART)
FIG. 2 is a cross-sectional view of the pump shown in FIG. 1 with first prior art compensating valve mounted thereon.
Figure 3:
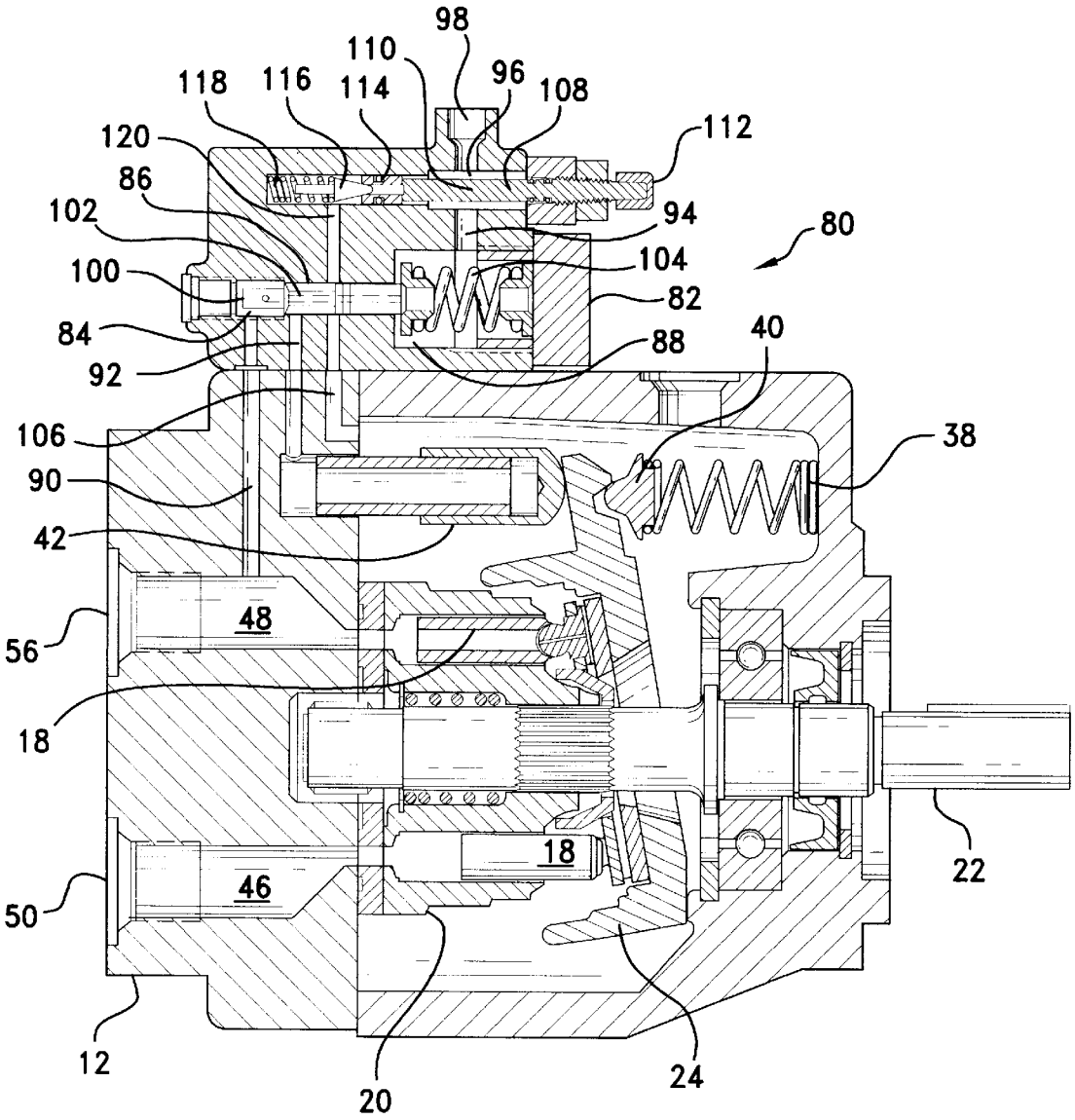
Fig. 3 (PRIOR ART)
FIG. 3 is a cross-sectional view of the prior art pump shown in FIG. 1 with a second prior art compensating valve mounted thereon.
Figure 4:
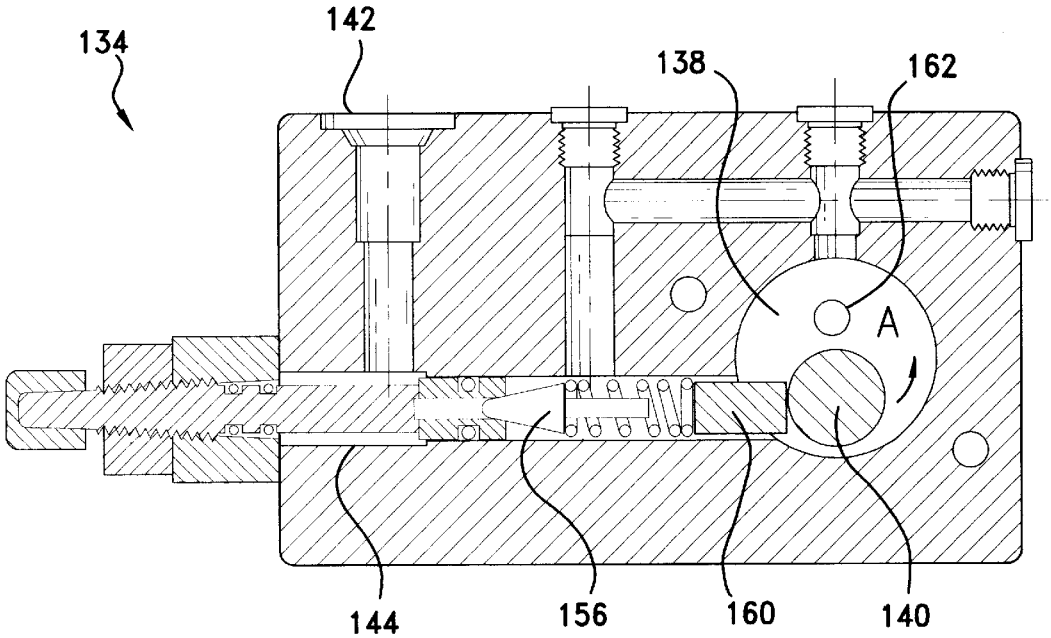
Fig. 4 (PRIOR ART)
FIG. 4 is a cross-sectional view of a variable pressure relief valve for the prior art pump shown in FIG. 1.
Figure 6:
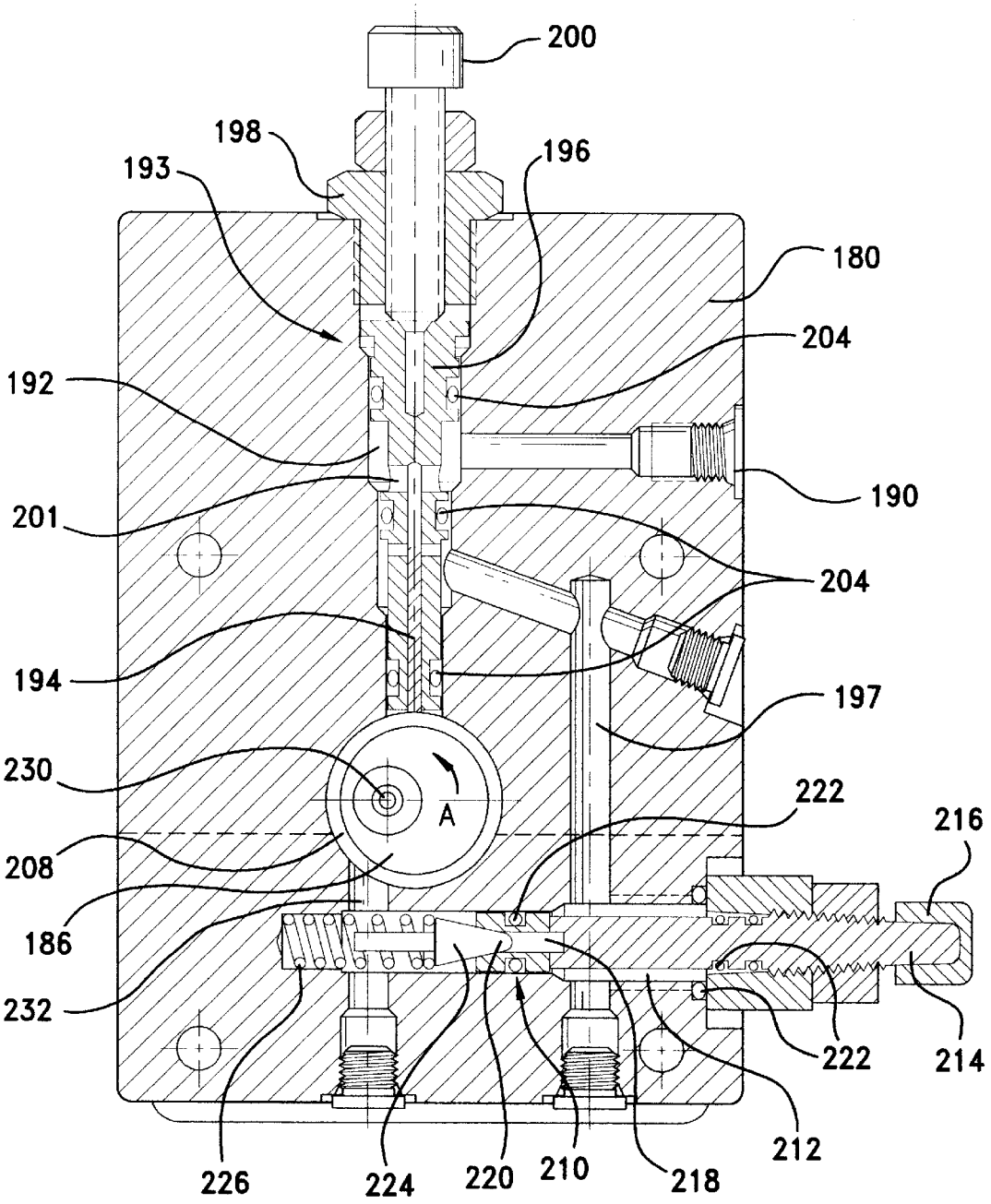
FIG. 6 is a cross sectioned enlarged view of the load-limiting control used in the preferred embodiment of the present invention.

A portion of load limiting control 180 is shown in sectioned in FIG. 6 to provide a side view of a pin 184. Pin 184 is attached to the swash plate of the pump and moves therewith. Extending from pin 184 is an offset cylindrical cam 186. Pump 170 has only one pin 184 which includes a cam. The opposed pin, which supports the side of the swash plate opposite pin 184, is a conventional pin similar to trunion pins 28 shown in FIG. 1.

The load limiting control 180 is shown in greater detail in FIG. 6. The control has an inlet passage 190 which is connected to pipe 178. Inlet passage 190 is in fluid communication with a main passage or chamber 192. A low-flow setting adjustment, indicated generally at 193, is provided in main passage 192. Low flow adjustment 193 comprises a valve including a control spool 194, which is closely and slidably received within a sleeve 196. Sleeve 196 is retained in passage 192 by a threaded retaining nut 198, and is generally urged (biased) outwardly from passage 192 by fluid pressure received from the inlet passage 190. A threaded adjustment screw 200 is received in nut 198 and can be rotated to adjust the longitudinal position of sleeve 196 in passage 192. Sleeve 196 includes an internal flow passage 201 to provide communication between inlet passage 190 and outlet passage 197. Appropriate O-rings and backup rings 204 are disposed between sleeve 196 and passage 192 to prevent fluid leakage therebetween.

Spool 194 generally comprises a rod or pin which is received within a longitudinal bore forming a portion of flow passage 201, and can be longitudinally moved within sleeve 196 to control or restrict flow through passage 201 to outlet passage 197. Spool 194 is urged inwardly into engagement against cam 186 by fluid pressure from inlet passage 190 applied through internal flow passage 201. The close spacing between spool 194 and sleeve 196 generally prevents fluid leakage into cavity 208 surrounding cam 186.

The spool 194 is moved longitudinally within sleeve 196 when cam 186 connected to the swash plate pin rotates from a first position shown in FIG. 6 where maximum flow is permitted through low-flow adjustment 193 (maximum flow through pump), to a second position where a minimum flow is permitted through low-flow adjustment 193 (minimum flow through pump). The adjustment of screw 200 determines the initial positioning of sleeve 196 with respect to spool 194, thereby tailoring the flow through the low flow adjustment 193 to the operating characteristics of the motor to maximize the output of the motor.

The load limiting control 180 also includes a high-flow cut-off adjustment, indicated generally at 210. The high-flow cut-off adjustment 210 comprises a valve including a main passage or chamber 212 which is in fluid communication with passage 197. An adjustable rod 214 is mounted in chamber 212 and is threaded therein to provide longitudinal adjustment by turning an adjustment screw 216. Rod 214 includes a flow passage 218 therein which is in fluid communication with passage 197. Flow passage 218 terminates at its inner end in a circular opening 220. O-ring seals and back-up rings, indicated at 222, are provided between rod 214 and passage 212 to insure that fluid delivered from passage 197 is directed only into inner flow passage 218.

A conical dart 224 is positioned adjacent to circular opening 220. Dart 224 serves as a blocking body for opening 220. Dart 224 is biased toward the opening by a compression spring 226. An opening 230 is also provided in pin 184. Opening 230 extends from cavity 208 to the interior of the pump case (to ambient). A fluid passageway 232 extends from passage 212 below dart 224, to cavity 208. Any fluid which passes through opening 220, past dart 224, is enabled to flow through passageway 232 into chamber 208. This flow may then flow into the low pressure pump case through opening 230. The adjustment of rod 214 against spring 226 using screw 216 varies the cracking pressure of dart 224, and hence the transition point from high flow to low flow.

When the cracking pressure of the low-flow cut-off adjustment 210 is exceeded, the dart 224 moves away from the opening 220 and pressure is relieved through passageway 232 to ambient. The pressure at the outlet 176 of the compensating valve 174 likewise decreases. If the pressure at the pump outlet is sufficient to overcome the force of the differential spring and the pressure remaining at outlet 176, the spool of the compensating valve moves to deliver fluid to the servo piston inside the pump. The piston enlarges, which reduces the angle of the swash plate, and hence the pump outlet flow. As the swash plate moves, it moves the low flow control spool, which restricts flow to the high-flow cut-off adjustment. With the low flow control at reduced flow, the pump remains at the reduced flow until the maximum pressure adjustment is reached. At this point, pressure relief valve 108 in the compensator cavity opens to prevent the maximum pressure capability of the pump from being exceeded. The cracking pressure of high-flow cut-off adjustment 210 can likewise be manually adjusted to so as not to exceed the motor's power delivery capability.

Figure 7:
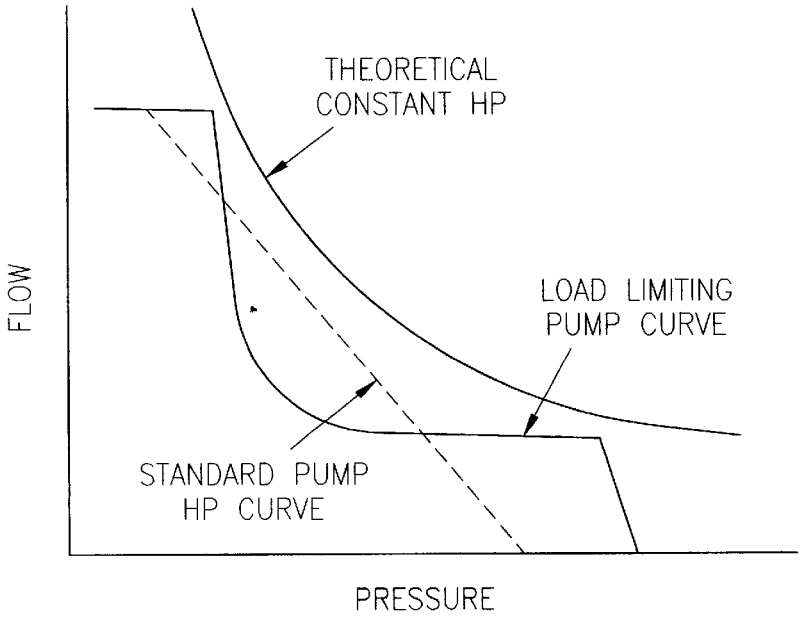
FIG. 7 is graph of the relationship of fluid flow to fluid pressure produced by a variable displacement rotating piston pump incorporating the preferred embodiment of the present invention.

The combined effect of the flow control through compensating valve assembly 174 with load limiting control 180 enables the fluid pump to achieve the performance curve shown in FIG. 7. The manual adjustment of the low flow setting and high flow cut-off allows the pump to be closely tailored to the theoretical capabilities of the motor. It can be seen that the pump can reach higher pressures while not exceeding the motor's power delivery capability. The load limiting control of the present invention allows the pump to effectively reach the theoretical horsepower curve of the motor at two locations, versus only one location for standard pumps utilizing a compensating valve without such control.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. A fluid power apparatus for delivering a liquid working fluid at an outlet, said fluid delivered at varying flow rates and pressures, power for said apparatus provided by a motor having a power output rating, said apparatus adapted to adjust said flow rate and said pressure at said outlet to avoid exceeding the power output rating of said motor means, said apparatus comprising;

a variable volume piston pump driven by said motor, said pump including an inlet in communication with a supply of said working fluid, an outlet, and a swash plate, said swash plate having a variable angle, the volume of fluid flow delivered from said outlet proportional to said angle, said pump further including a servo piston in operative connection with said swash plate for varying the angle of said swash plate;

a cam in operative connection with said swash plate, said cam moveable responsive to the angle thereof between a first position and a second position, said pump delivering a maximum fluid flow when said cam is in the first position and a minimum fluid flow when said cam is in a second position;

a compensation valve portion, said compensation valve portion including a CV inlet in fluid communication with the outlet of the pump, and a CV outlet, said compensation valve portion further including a first CV passage in fluid communication with said servo piston of said pump, said compensation valve portion further including an outlet flow passage for delivery fluid from said CV outlet to said pump outlet; said compensation valve portion further including a pressure-responsive valve for delivering fluid from said CV inlet to said first CV passage responsive to a differential pressure between said CV inlet and said CV outlet; and a load-limiting control in operative connection with said cam and said CV outlet for controlling fluid pressure at said CV outlet above a cracking pressure, said fluid control variable with the position of said cam, and at a minimum restriction when said cam is in the first position and a maximum restriction when said cam is in the second position;

whereby when said cam is in said first position and the cracking pressure is exceeded, fluid flows from said CV outlet, and the differential pressure between said CV inlet and said CV outlet enables fluid to be delivered to said servo piston changing the angle of said swash plate and moving said cam toward said second position, whereby said flow rate from said CV outlet is reduced and said flow is maintained at a reduced rate until a maximum relief pressure of the compensating valve portion is exceeded.

2. The apparatus according to claim 1 wherein said load limiting control includes:

a low flow setting adjustment comprising a control valve which is at a minimum restriction when the cam is in the first position and a maximum restriction when the cam is in the second position, and operatively engaged by said cam, and a high-flow cut-off comprising a cut-off valve having a preset cracking pressure.

3. The apparatus as in claim 2, wherein said low flow control includes means for manually adjusting the metering of flow through the control valve, and said high-flow cut-off includes means for manually adjusting the cracking pressure of the cut-off valve.

4. The apparatus as in claim 2, wherein said low flow control valve comprises:

a sleeve retained in a passage fluidly connected to the CV outlet and the high-flow cut-off valve, and a spool closely slideably received in said sleeve, said spool being in operative engagement with said cam and moveable longitudinally within the sleeve thereby, the relative positioning of said sleeve with respect to said spool metering the fluid through the low flow control valve.

5. The apparatus as in claim 4, wherein said low flow control valve includes means for manually adjusting the metering of flow through the control valve.

6. The apparatus as in claim 2, wherein said high-flow cut-off valve comprises:

a flow passage interconnecting the low flow control valve and ambient;

a body adapted for blocking said flow passage; and biasing means for biasing said blocking body in abutting relation of said flow passage.

7. The apparatus as in claim 6, wherein said high-flow cut-off valve includes means for manually adjusting the biasing force of the blocking body.

8. A system for limiting the load on a variable displacement rotating piston pump, said pump having a moveable swash plate, said system including a pressure compensating valve including an outlet, the flow of said pump being controlled responsive to a control pressure at said outlet; an improvement comprising:

load control means for controlling the low-flow setting of the pump and for adjusting the point at which the pump transitions from high-flow to low-flow, said load control means in fluid communication with said outlet of said compensator valve and in operative connection with said swash plate;

wherein when said swash plate is at a minimum angle said load control means has maximum restriction of flow from the outlet and when said swash plate is at a minimum angle said load control means has a minimum restriction of the flow from the outlet.

9. The system according to claim 8 wherein said swash plate is connected in said pump to a pin and said pin is in operative connection with a cam, said load control means in engagement with said cam.

* * * * *